US008245646B1

(12) United States Patent
Miller et al.

(10) Patent No.: US 8,245,646 B1
(45) Date of Patent: Aug. 21, 2012

(54) ARTICULATED RAIL VEHICLE

(75) Inventors: Robert S. Miller, Columbia, SC (US); Anthony P. Delucia, Gaston, SC (US)

(73) Assignee: Harsco Technologies Corporation, Fairmont, MN (US)

( * ) Notice: Subject to any disclaimer, the term of this patent is extended or adjusted under 35 U.S.C. 154(b) by 719 days.

(21) Appl. No.: 12/359,742

(22) Filed: Jan. 26, 2009

(51) Int. Cl.
*E01B 27/16* (2006.01)
*B61F 3/12* (2006.01)

(52) U.S. Cl. ..... 104/12; 105/4.3

(58) Field of Classification Search ..... 104/2, 10, 104/12; 105/4.1, 4.3, 199.2; 213/78, 86, 213/98
See application file for complete search history.

(56) References Cited

U.S. PATENT DOCUMENTS

| | | | | |
|---|---|---|---|---|
| 4,449,459 | A * | 5/1984 | Cicin-Sain | 104/12 |
| 4,760,797 | A | 8/1988 | Stubbs et al. | |
| 5,031,542 | A * | 7/1991 | Theurer | 104/12 |
| 5,320,045 | A * | 6/1994 | Theurer | 104/2 |
| 5,664,633 | A * | 9/1997 | Theurer et al. | 171/16 |
| 2007/0199471 | A1 * | 8/2007 | Theurer et al. | 104/2 |

* cited by examiner

*Primary Examiner* — S. Joseph Morano
*Assistant Examiner* — Zachary Kuhfuss
(74) *Attorney, Agent, or Firm* — McNees Wallace & Nurick LLC

(57) ABSTRACT

A dual tamper vehicle is provided. The dual tamper vehicle has a single articulated frame assembly having two sets of tampers. The articulated frame assembly is, essentially, a bifurcated vehicle having a forward, first vehicle and a trailing, second vehicle joined by a primary coupling having three axes of rotation. The primary coupling having three axes of rotation allows the two vehicles to roll, pitch, and yaw relative to each other thereby allowing the single, long rail bifurcated vehicle to travel over a railroad.

21 Claims, 3 Drawing Sheets

ARTICULATED RAIL VEHICLE

FIELD OF THE INVENTION

This application relates to railroad maintenance vehicles and, more specifically to a single, bifurcated maintenance vehicle having dual tampers for each rail.

BACKGROUND INFORMATION

Generally, a railroad includes at least one pair of elongated, substantially parallel rails coupled to a plurality of laterally extending ties and which are disposed on a ballast bed. The rails are coupled to the ties by metal tie plates and/or spring clips. The ballast is a hard particulate material such as, but not limited to, gravel. Ties may be made from either concrete or wood. The ballast filled space between ties is called a crib. Concrete ties are typically spaced about twenty-four inches apart, whereas wood ties are spaced about nineteen and a half inches apart.

During installation and maintenance various operations must be performed at each tie location. For example, ballast must be "tamped," or compressed, to ensure that the ties, and therefore the rails, do not shift. A tamping device, not surprisingly called a "tamper," typically consists of a pair of parallel tampers mounted on a motorized vehicle structured to travel on the rails. Each tamper has at least one work head that includes a pair of elongated, vertically extending tools structured to move together in a pincer-like motion as well as being structured to move vertically. The tools, preferably, have two prongs spaced so that each prong may be disposed on opposite lateral sides of a rail. The tamper further includes a vibration device structured to rapidly vibrate the tools. In this configuration, a work head may be disposed above a worksite tie with one tool on either side of the tie. Further, the prongs of each tool may be disposed on either sides of the rail. Thus, a tool prong is disposed above, and just outside, of each corner of the rail/tie interface. At least two generally parallel tampers are used so that one work head may be placed over each rail on a single tie.

Initially, the tools are generally vertical and parallel to each other. When actuated, the tool head moves vertically downward so that the tips of the tools, i.e. the tips of the prongs, are inserted into the ballast to a predetermined depth that is, preferably, below the bottom of the tie. The tools are then brought together in a pincer-like motion thereby compressing the ballast under the tie. Actuation of the vibration assembly further compresses the ballast under the tie. Once the vibration operation is complete, the tools are returned to a substantially vertical orientation and lifted out of the ballast. The rail vehicle then advances to the next tie and the operation is repeated. Typically, a tamping operation lasts about three seconds.

It is noted that the act of advancing the rail vehicle to the next work location may be called "indexing." Indexing may be performed one tie at a time, or multiple ties at a time. For example, some tamping machines include a set of tamping tools at the front end of the rail vehicle and another set of tamping tools at the back end of the vehicle or on a chase vehicle. After identifying a tie at the work site as the first tie, the front set of tamping tools may work upon the "odd" ties and the back set of tamping tools may work upon the "even" ties. In this situation, the tamper vehicle would index, i.e. move forward, two ties at a time. The tamper vehicle, as well as other rail installation and maintenance vehicles, typically locates the tie/rail interface by locating the tie plate that connects the rail to the tie, e.g. by utilizing a metal detector that travels beside the rail.

It is noted that, "dual" tamper in this application means two tampers per rail and not two parallel tampers disposed over parallel rails, which is typical. It is further noted that, due to the size limitations of the equipment involved, there are no single vehicle solutions that incorporate all the elements of a dual tamper vehicle. For example, different sets of tampers may not act upon adjacent ties, yet, due to the forces involved, both tampers must be disposed between, i.e. supported by, rail wheels on either side.

Thus, one set of tampers has typically been disposed on a chase vehicle. Further, between the equipment used to locate and track the positions of ties, the size of the tampers and the need for an operator cabin, a single rail vehicle would be too long to effectively operate. The traditional solution was to place certain equipment on a separate vehicle. For example, the tie locating equipment or the second pair of tampers would be located on a lead or chase vehicle.

It must also be noted that, unlike most road vehicles, rail vehicles do not have an independent suspension for each wheel. Thus, assuming a rail vehicle has a rigid frame and four wheels, if all the wheels were fixed to the rail vehicle frame assembly and if one of the rails had a low spot, e.g. a spot in need of repair, the rail vehicle may be placed in a position wherein it is supported by three of the wheels allowing a gap between the fourth wheel and the rail. There are many reasons, including safety, why this is not desirable. To address this situation, most rail vehicles have one pair of wheels, or one wheel carriage having four wheels, pivotally coupled to the rail vehicle frame and structured to pivot about a longitudinal axis (almost all rail wheels, or wheel carriages, are structured to rotate about a vertical axis so that the vehicle can travel over curves). By allowing one set of wheels to pivot about a longitudinal axis while the other set of wheels does not, causes the rail vehicle frame assembly to be, essentially, supported by three points (the minimum number of support points for stability). Thus, when such a rail vehicle travels over a low spot on a single rail, the set of wheels that may pivot longitudinally rotate relative to the frame assembly so that all the wheels stay in contact with the rails.

This configuration, however, essentially prevents the construction of segmented rail vehicles. That is, assuming the segments of the vehicle are coupled by a typical railroad vehicle coupling, any segment of a rail vehicle supported only by a set of wheels having a longitudinal pivot would simply fall over. As noted above, any segment of such a rail vehicle supported by the wheels coupled to a longitudinal pivot would be, essentially, supported by a single point which may rotate. In such a configuration, gravity would cause the frame assembly to rotate about the longitudinal pivot until the frame assembly contacted the ground or another fixed object.

SUMMARY OF THE INVENTION

At least one embodiment of the disclosed invention provides a dual tamper vehicle having a single articulated frame assembly having two sets of tampers. The articulated frame assembly is, essentially, a bifurcated vehicle having a forward, first vehicle and a trailing, second vehicle joined by a primary coupling having three axes of rotation. The primary coupling having three axes of rotation allows the two vehicles to roll, pitch, and yaw relative to each other thereby allowing the single, long bifurcated vehicle to travel over a railroad. The first vehicle includes a frame assembly and one set of rail wheels. The first vehicle wheels are, preferably, coupled to the first frame assembly by a longitudinal pivot. This allows the wheels and the first frame assembly to articulate relative to each other so that some relative movement at the primary coupling is reduced. The first vehicle further includes one pair of tampers, a propulsion system, control system, an operator's cab and a navigation system.

The second vehicle includes a second frame assembly, a second pair of tampers, and, preferably, a secondary propulsion system. The second pair of tampers are, preferably, independently movable in a longitudinal direction. This allows the second pair of tampers to tamp skewed ties. The second vehicle includes two sets of wheels; one set being in a fixed relation relative to the second frame assembly and one set coupled to the second frame assembly by a longitudinal pivot. Thus, the second vehicle frame assembly is supported by three points.

The first vehicle frame assembly further includes a connection, preferably a yoke assembly, that extends to the second vehicle. The yoke assembly is coupled to the primary coupling having three axes of rotation. The yoke assembly includes two arms having a lower surface. The yoke assembly arm lower surfaces, which may include slider pads, are each structured to be spaced very close to, or in contact with, the second vehicle frame assembly. In this configuration, the first frame assembly also has three support points; namely, the coupling with the first vehicle wheel assembly, the primary coupling, and one of the yoke assembly arm lower surfaces. As the second vehicle is also supported by three points, the entire bifurcated vehicle is stable.

BRIEF DESCRIPTION OF THE DRAWINGS

A full understanding of the invention can be gained from the following description of the preferred embodiments when read in conjunction with the accompanying drawings in which:

FIG. 3 is a ball joint.

DESCRIPTION OF THE PREFERRED EMBODIMENTS

As used herein, "coupled" means a link between two or more elements, whether direct or indirect, so long as a link occurs. Unless otherwise noted, this does not include elements resting on, or supported by, a surface. For example, a seat in an automobile is coupled to the engine via the frame and other components. The seat is not, however, coupled to an adjacent automobile via the ground.

As used herein, "directly coupled" means that two elements are directly in contact with each other.

As used herein, "fixedly coupled" or "fixed" means that two components are coupled so as to move as one while maintaining a constant orientation relative to each other.

As used herein, a "worksite tie" is the tie located below a tamper. Thus, as the rail vehicle moves, different ties each become a "worksite tie" in turn.

As used herein, the "longitudinal" direction of the rail vehicle extends generally parallel to the direction of the rails of the railroad. Thus, the "lateral direction" extends generally perpendicular to the direction of the rails of the railroad.

As used herein, and when discussing the orientation of a frame assembly, "roll" corresponds to rotation about a longitudinal axis, "pitch" corresponds to rotation about a lateral axis, and "yaw" corresponds to rotation about a generally vertical axis.

As used herein "rail wheels" are wheels structured to support the weight of a rail vehicle. Other wheels, such as, but not limited to, wheels on a distance encoding device are not rail wheels.

Figure 1:
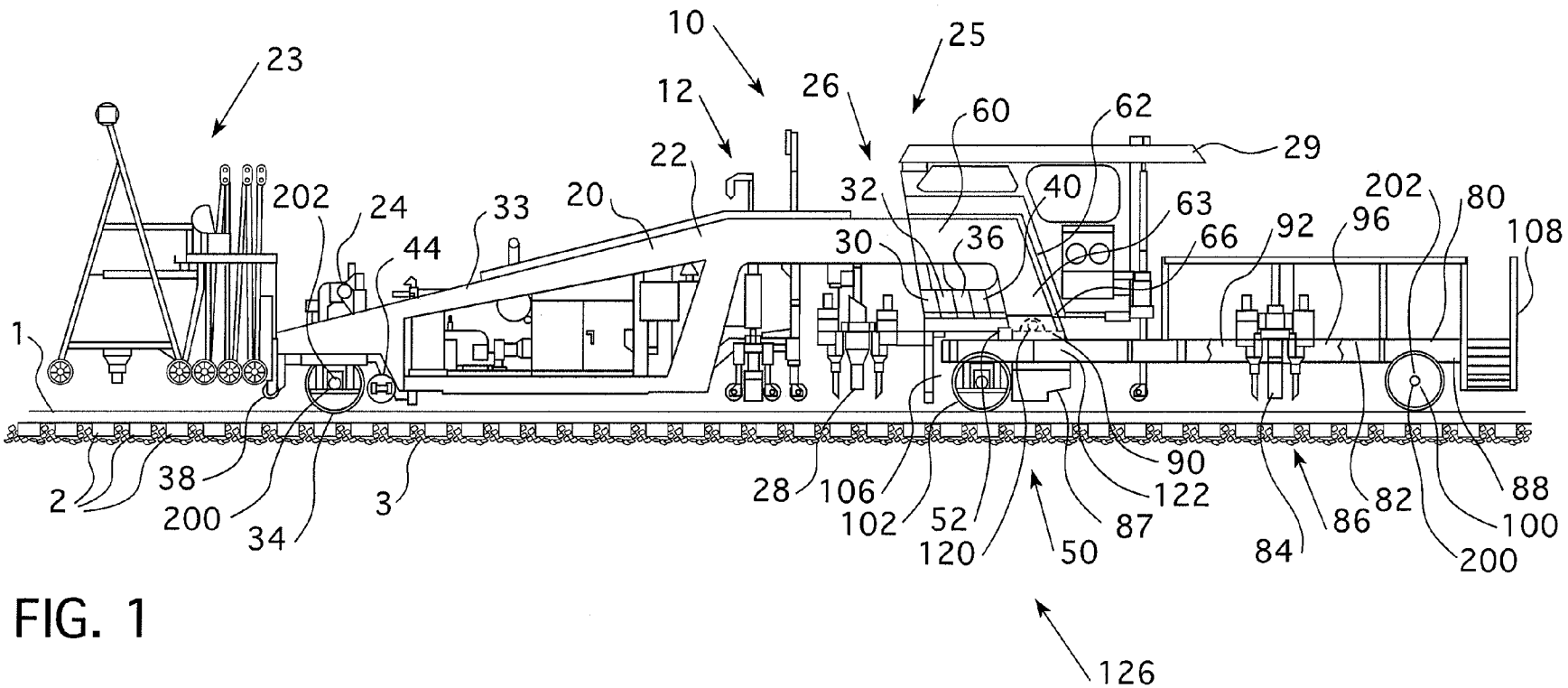
FIG. 1 is a side view of a bifurcated railroad maintenance vehicle.
Figure 2:
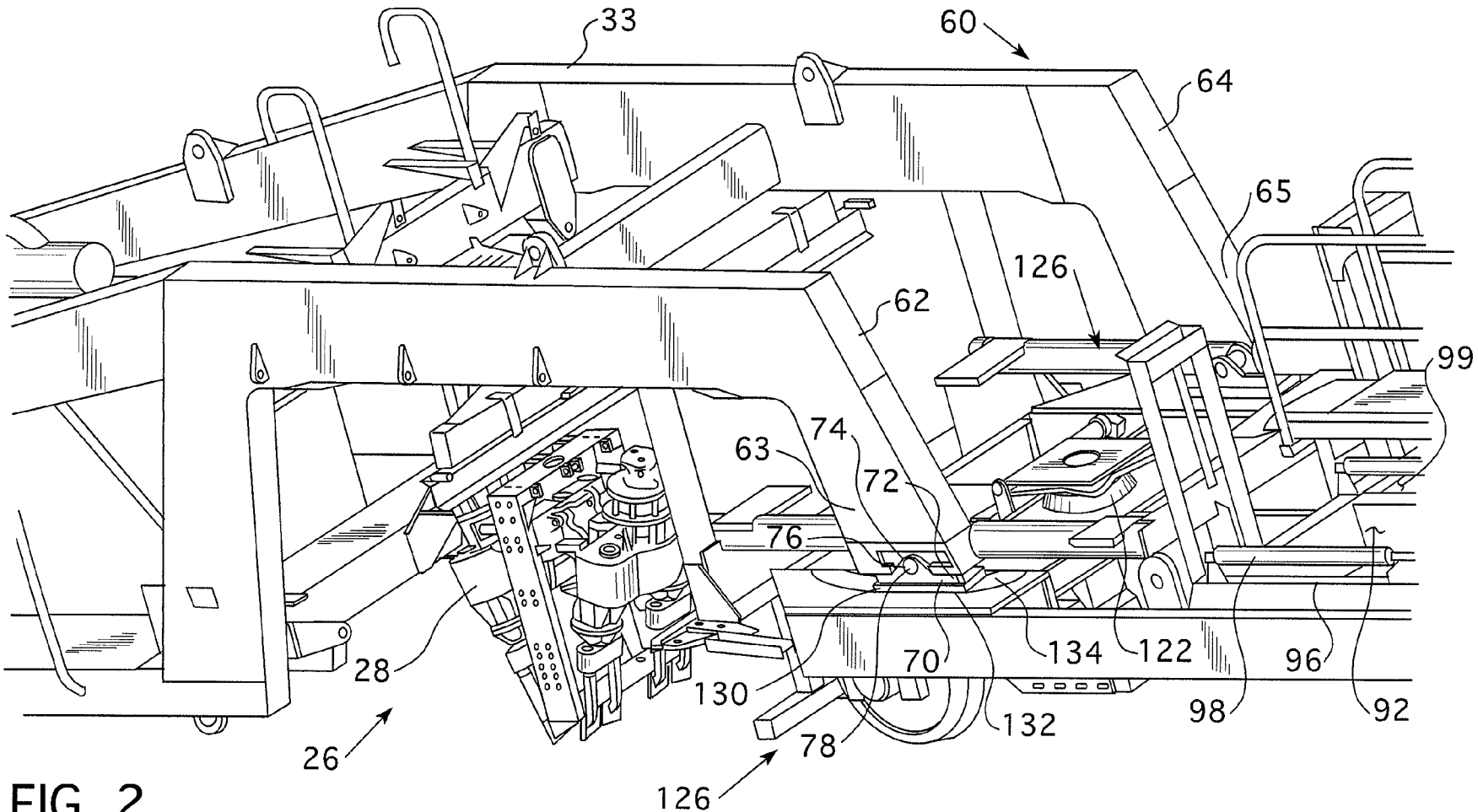
FIG. 2 is a partial isometric view showing the primary coupling.

As shown in FIG. 1, a railroad includes a pair of rails 1 disposed on a series of ties 2 which are further disposed on a bed of ballast 3. The ties 2 are generally perpendicular to the rails 1, however, some ties 2 may be skewed so as to not be generally perpendicular to the rails 1. The rails 1 and ties 2 are coupled together by a tie fastener (not shown) such as, but not limited to, tie plates, springs, or clips, The tie fastener is made from metal. Thus, a device structured to detect metal may detect a tie 2 position by locating the tie fastener.

The dual tamper vehicle 10 is structured to travel over a railroad rails 1. The dual tamper vehicle 10 includes a bifurcated vehicle assembly 12 having a first vehicle assembly 20 and a second vehicle assembly 80. The first vehicle assembly 20 and the second vehicle assembly 80 are coupled by a primary coupling 120 having three axes of rotation, as described below. Preferably, the overall length of the dual tamper vehicle 10 is between about fifty-two ft. and sixty-five ft., and, more preferably about fifty-five ft. The wheel base of the first vehicle 20, i.e. the length between the first rail wheel assembly 34 (described below) and the third rail wheel assembly 102 (described below) is between about forty-six ft. and fifty-six ft., and more preferably about forty-seven ft. The wheel base of the second vehicle assembly 80, i.e. the length between the second rail wheel assembly 100 (described below) and the third rail wheel assembly 102 is between about eighteen ft. and twenty-four ft. and more preferably about nineteen ft.

The first vehicle assembly 20 includes a frame assembly 22, an optional propulsion device 24 structured to move the dual tamper vehicle 10, an operating device 26, shown as at least one tamping device 28, also identified hereinafter as a "tamper," structured to tamp ties 2 as set forth above, an operator's cab 29, a control system 30 (shown schematically), and a navigation system 32 (shown schematically). Preferably, there are two parallel first vehicle operating devices 26, one located above each rail 1. When the operating devices 26 are tampers 28, the tampers 28 typically operate in tandem. That is, both sides of the tie 2 will be tamped about simultaneously. Accordingly, hereinafter it is understood that, generally, any description of a tie 2 being tamped means that both parallel tampers 28 have been actuated. It is noted that there may be special circumstances wherein only one end of a tie 2 is tamped, this, however, is unusual.

The first vehicle frame assembly 22 includes a plurality of rigid frame members 33 and a first rail wheel assembly 34 structured to travel on the rails 1. The first rail wheel assembly 34, as well as the second and third rail wheel assemblies 100, 102 (discussed below), each have a pair of rail wheels 200 coupled by an axle 202. The axle 202 of the first rail wheel assembly 34 is coupled to the first vehicle frame assembly 22 by a coupling (not shown) structured to rotate about a longitudinal axis. For example, a circular collar (not shown) may be disposed about the axle 202, thereby allowing the axle 202 to rotate, and a yoke (not shown) having a longitudinal pivot may extend between the collar and the vehicle frame assembly 22. Such a rotation about a longitudinal axis shall be identified as having "a pivotal relation with" a frame assembly 22, 82. It is noted that rail wheel assemblies do not typically rotate about a vertical axis. Rather, rail wheels 200 have a wide, frustoconical profile so as to allow a rail vehicle to travel over curves with the wheels (200) shifting laterally relative to the rails 1. Thus, the first vehicle first rail wheel assembly 34 has a pivotal relation with the first frame assembly 22, and the first vehicle first rail wheel assembly 34 may "roll" relative to the first frame assembly 22, i.e. rotate about a longitudinal axis. Of course, all rail wheels 200 also rotate with, or about, their axle 202 as the rail wheels 200 roll over the rails 1.

The control system 30 is, preferably, a programmable device such as, but not limited to, a programmable logic circuit or computer, having memory for executing programs and for storing both executable programs as well as data. The control system 30 may include one or more programmable devices disposed at various locations on the dual tamper vehicle 10 and each device may be substantially responsible for controlling a specific element of the dual tamper vehicle 10, e.g. one device may control each first vehicle tamper 28. The elements that comprise the control system 30 may also extend to the second vehicle assembly 80. The control system 30 includes a communication system 36 (shown schematically), a tie detection device 38, and a tie location system 40 (shown schematically). The communication system 36 is structured to allow electronic communication between the various components of the control system 30 as well as with the navigation system 32 and may be a wireless system, a hardline system, or a combination thereof. The detection device 38 is structured to detect the location of each tie 2. As noted above, each tie includes a metal fastener structured to couple the rail 1 to the tie 2. Thus, the detection device 38 typically includes a device structured to detect the tie fastener. Tie 2 location data is communicated to, and stored within, the control system 30. Data indicating that a tie 2 was detected may be combined with navigation system 32 data, discussed below, to determine a tie's 2 location and when a tie 2 is skewed relative to the rails 1.

The navigation system 32 is structured to track the position of the dual tamper vehicle 10 relative to a fixed location, such as, but not limited to, a location on the ground. The navigation system 32 is, preferably, equipped with an encoder wheel 44, or other tracking device, that measures the generally linear movement of the dual tamper vehicle 10 over the rails 1. If an encoder wheel 44 is used, the motion of the dual tamper vehicle 10 is measured in pulses per revolution. That is, the speed (rotation/time) for each revolution of the encoder wheel 44 is tracked. While the dual tamper vehicle 10 is moving forward, the encoder wheel 44 is turning in a counterclockwise motion, as shown in the figures. The speed of the dual tamper vehicle 10, or "movement data," is determined either constantly (analog) or, more typically, many times each second (digital), and that data is converted to an electronic signal and communicated to the control device 30. This data is typically combined with the tie 2 detection data so as to determine the position of each tie 2. If the tie 2 position data indicates that the tie 2 fasteners on different sides of a tie 2 are not substantially the same distance from the adjacent tie 2, the control system 30 may determine that the tie 2 is skewed.

The control device 30 is further structured to control the first vehicle propulsion device 24 to effect the forward motion of the dual tamper vehicle 10 and to stop the dual tamper vehicle 10 when the at least one tamping device 28 is positioned over the tie 2 to be tamped. When the tamping device 28 is positioned over the worksite tie 2, the control device 30 is structured to actuate the first vehicle tamping devices 28, as well as the second vehicle tamping devices 86 (described below), as is known in the art.

The control device 30 also includes an orientation system 50 having a plurality of position sensors 52. The orientation system 50 is structured to determine the relative position of the first frame assembly 22 and said second frame assembly 82, described below. The orientation data is provided to the control device 30 via the communication system 36. The control device 30 is structured to combine the orientation data with the tie 2 position data so that the control device 30 may properly position the second vehicle tamping devices 86.

The first vehicle frame assembly 22 has a front end 23 and a back end 25, as well as a yoke assembly 60. The yoke assembly 60 is disposed at the first vehicle frame assembly back end 25 and is structured to be coupled to the second vehicle 80. The yoke assembly 60 includes two spaced arms 62, 64 and a crossbar 66. The yoke assembly arms 62, 64 are spaced and each extends from the first vehicle frame assembly back end 25. The crossbar 66 extends between, and is fixed to, the distal ends of the yoke assembly arms 62, 64. The connection of the yoke assembly 60 to the primary coupling 120 is discussed in detail below. Further, the yoke assembly arms distal ends 63, 65 (discussed below) preferably, extend toward the second vehicle 80 at a downward angle or even vertically. Each yoke assembly arms distal ends 63, 65 may include a shoe 70 that is structured to pivot about a lateral axis. The reasons for this preferred configuration and the associated components are best left until after a discussion of the second vehicle 80 and are described in detail below. The operator's cab 29 is, preferably, disposed on the crossbar 66 and between the yoke assembly arms 62, 64.

The second vehicle 80 includes a frame assembly 82 an operating device 84, shown as at least one tamping device 86 structured to tamp ties 2 as set forth above. The second vehicle 80 may also include a, or may include the only, propulsion device 87. Preferably, there are two parallel second vehicle operating devices 84, one located above each rail 1. The second vehicle frame assembly 82 includes a plurality of rigid frame members 88 including a generally planar pivot bed 90 disposed about said primary coupling 120. The second vehicle frame assembly 82 also includes two longitudinal openings 92, 94 with one longitudinal opening disposed over each rail 1. The tamping devices 86 are movably disposed in the longitudinal openings 92, 94 and are structured to independently move in a longitudinal direction. This may be accomplished by a configuration such as, but not limited to, having longitudinal support rails 96 on the lateral sides of the longitudinal openings 92, 94 and pistons 98 structured to move the tamping devices 86. The pistons 98 are controlled by the control device 30 and moved into a position over a worksite tie 2 based on the various data, e.g. tie 2 position data and orientation data, collected by the control device 30.

The second vehicle frame assembly 82 includes a second rail wheel assembly 100 and a third rail wheel assembly 102, each having a pair of rail wheels 200 disposed on an axle 202. The second rail wheel assembly 100 has "a pivotal relation with" the second vehicle frame assembly 82, as that phrase is defined above. That is, the axle 202 of the second rail wheel assembly 100 is coupled to the second vehicle frame assembly 82 by a coupling (not shown) structured to rotate about both a vertical axis and a longitudinal axis. Thus, the second vehicle frame assembly 82 may "roll" relative to the second rail wheel assembly 100, i.e. rotate about a longitudinal axis. The third rail wheel assembly 102, however, has a "fixed relationship" to the second vehicle frame assembly 82. As noted above, almost all rail wheel assemblies may rotate about a vertical axis relative to the associated frame assembly, and so does the third rail wheel assembly 102, however, as this is the only axis about which the third rail wheel assembly 102 may rotate, the third rail wheel assembly 102 is identified as having a "fixed relationship" to the second vehicle frame assembly 82. That is, the axle 202 of the third rail wheel assembly 102 is coupled to the second vehicle frame assembly 82 by a coupling (not shown) structured to rotate only about a vertical axis.

Figure 3A:
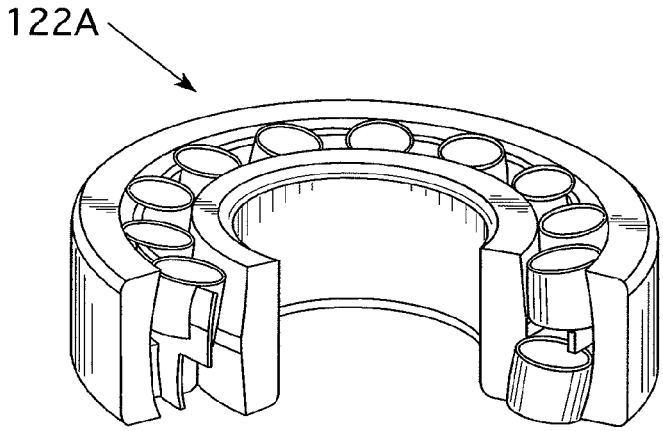
FIG. 3A is a spherical bearing.
Figure 3B:
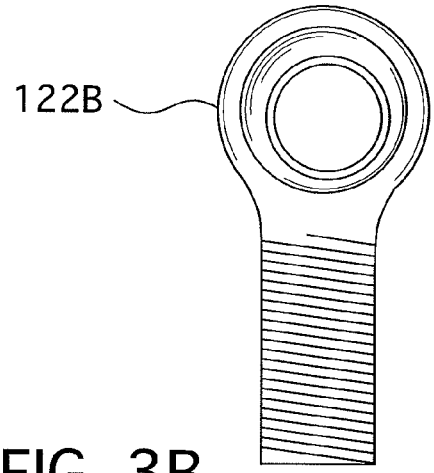
FIG. 3B is a heim joint.
Figure 3C:
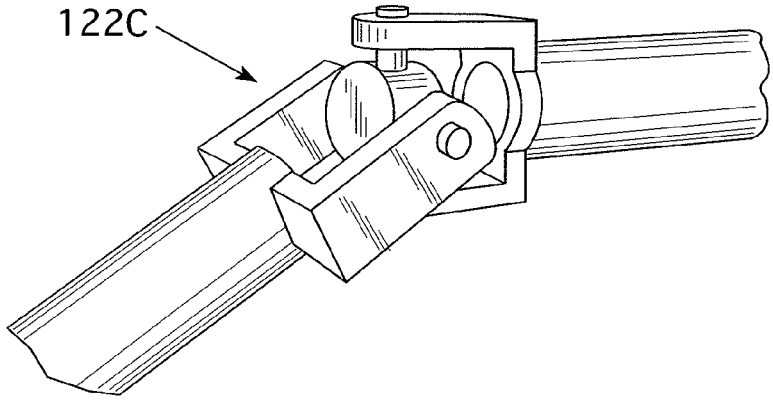
FIG. 3C is a universal joint.

The second vehicle frame assembly 82 has a front end 106 and a back end 108. Preferably, the primary coupling 120 is disposed at the second vehicle front end 106. The primary coupling 120, in one simple form, is a ball joint 122. That is, for example, the second vehicle frame assembly 82 includes a spherical extension (not shown) and the yoke assembly cross bar 66 includes a spherical cup 124 extending from its lower surface and opening downwardly. The spherical cup 124 is placed over the spherical extension thereby coupling the first and second vehicle assemblies 20, 80. As a ball joint 122, the coupling has three axes of rotation, however, as discussed below, the manner in which the yoke assembly 60 engages the second vehicle 80 substantially limits the "roll" of the vehicles relative to each other. Thus, the primary coupling 120, effectively, has at least two axes of rotation. The primary coupling 120 may be selected from known multi-axes couplings such as a ball joint 122, a spherical bearing 122A (FIG. 3A), a heim joint 122B (FIG. 3B), or a universal joint 122C (FIG. 3C), as well as a combination joint 126, as defined below.

In the preferred embodiment, the primary coupling 120 is a combination joint 126. As used herein, a "combination joint" combines the elements of a ball joint 122 and an independent pivot. That is, in addition to the spherical cup 124 and the spherical extension which form the ball joint 122, the yoke assembly arm distal ends 63, 65 (described below) each include a shoe 70 structured to pivot about a lateral axis. As noted above, the reasons for this configuration will be better understood once the relationship between the first and second vehicles 20, 80 is described and will be set forth in detail below. For now it is noted that the primary coupling 120 having at least two axes of rotation allow the first and second frame assemblies 22, 82 to be articulated relative to each other.

The combination joint 126 allows for the first and second frame assemblies 22, 82 to move into various orientations relative to each other. That is, assuming for the sake of this description that the second vehicle 80 is the primary reference, the first vehicle 20 may roll, pitch and yaw, relative to the second vehicle 80. For example, when the dual tamper vehicle 10 initially starts to climb a hill, the first vehicle 20 will have a slightly upward pitch relative to the second vehicle 80. Similarly, if the first vehicle moves over a section of the rails 1 wherein one rail 1 is lower than the other rail 1', a portion of the first vehicle 20 will roll relative to the second vehicle 80. More specifically, the first rail wheel assembly 34, roll relative to the first frame assembly 22 as described above. Finally, any time the dual tamper vehicle 10 goes around a curve, the first vehicle 20 will yaw relative to the second vehicle 80. Of course, each of these relative orientations may occur at the same time. For example, when the dual tamper vehicle 10 is on a curve that begins to climb a hill, and where one rail 1 is lower than the other rail 1', the first vehicle 20, or a portion thereof, may roll, pitch and yaw, relative to the second vehicle 80. As noted above, an orientation system 50 has a plurality of position sensors 52, which are typically disposed about the primary coupling 120 and/or the interface of the first and second vehicles 20, 80, structured to measure the relative roll, pitch and/or yaw of the first and second vehicles 20, 80. Further, the first vehicle 20 and second vehicle 80 do not move longitudinally relative to each other.

As noted above, when a wheel assembly 34, 100 has "a pivotal relation with" an associated vehicle frame assembly 22, 82, the frame assembly 22, 82 may roll about a longitudinal axis relative to the wheel assembly 34, 100. Further, as noted above, almost all wheel assemblies 34, 100 permit rotation about a vertical axis so that the rail vehicle may go about curves. Thus, when a wheel assembly 34, 100 has "a pivotal relation with" an associated vehicle frame assembly 22, 82, that wheel assembly only prevents rotation about a lateral axis. That is, the rail vehicle may not "pitch" relative to the coupling between the rail wheel assembly 34, 100 and the associated frame assembly 22, 82. In essence, this means that a wheel assembly 34, 100 having "a pivotal relation with" an associated vehicle frame assembly 22, 82 only provides one support point. As is well known, the minimum number of support points needed for stable support of an object, such as a rail vehicle, is three points. In the present dual tamper vehicle 10, the other two support points are provided by the "fixed" wheel assembly, i.e. the third wheel assembly 102. That is, the fixed third rail wheel assembly 102, only allows for rotation about a vertical axis, and therefore acts as two support points. Thus, the second vehicle 80 is stable as it is supported by three points.

The first vehicle 20 is, by itself, unstable; however, when the first vehicle 20 is coupled to the second vehicle 80, the first vehicle 20 gains the benefit of the second vehicle's 80 fixed third wheel assembly 102. That is, the first vehicle 20 is effectively supported by three points. In the preferred embodiment, the first rail wheel assembly 34 is disposed at the first vehicle front end 23, the second rail wheel assembly 100 is disposed at the second vehicle frame assembly back end 108, and the third rail wheel assembly 102 is disposed at the second vehicle frame assembly front end 106. That is, the fixed third rail wheel assembly 102 is disposed between the two rail wheels assemblies having a pivotal relation with one of the first frame assembly 22 or the second frame assembly 82. Further, the fixed third rail wheel assembly 102 is, preferably, disposed near to the primary coupling 120. Thus, the fixed third rail wheel assembly 102 effectively acts as a fixed support for both the first and second vehicles 20, 80.

As the first vehicle 20 is not directly coupled to the fixed third rail wheel assembly 102, the following first/second vehicle 20, 80 interface is noted. While the first vehicle 20 may rotate about a longitudinal axis, the over-rotation, i.e. falling over to one side, of the first vehicle 20 is prevented by having the first vehicle 20 engage, i.e. contact, the second vehicle 80. More specifically, the first vehicle frame assembly 22 engages the second vehicle frame assembly 82. In the preferred embodiment, the yoke assembly arms 62, 64 engage the second vehicle frame assembly 82. That is, the lower surface of the yoke assembly arms 62, 64 are structured to engage the planar pivot bed 90. However, it is initially noted that, as shown in the Figures, the yoke assembly arms 62, 64 are disposed in a relatively high plane and have descending distal ends 63, 65. This configuration allows for the operator cab 29 to be disposed between the yoke assembly arms 62, 64 but, more importantly, allows for a limited area of engagement, and therefore reduced friction, between the lower surface of the yoke assembly arms 62, 64 and the pivot bed 90. It is noted that this configuration is not required. For example, rather than a yoke assembly 60, the first and second vehicles 20, 80 could be coupled by a single member (not shown) disposed generally in the plane of the second vehicle frame assembly 82 shown in the figures.

The yoke assembly arms distal ends 63, 65, which in this configuration are the lower surfaces of the yoke assembly arms 62, 64, engage, i.e. contact, the pivot bed 90. Preferably, each yoke assembly arms distal end 63, 65 includes a shoe 70. Each shoe 70 is an elongated, generally flat member 72 sized to extend across the bottom of the associated yoke assembly arms distal end 63, 65 and structured to engage the pivot bed 90. The upper surface of each shoe 70 includes a flange 74 having an opening 76 extending in the lateral direction. The yoke assembly crossbar 66 includes two pivot pin 78 extending from opposite lateral sides of the crossbar 66 and extending through the shoe opening 76. Thus, each shoe 70 is structured to pivot about a lateral axis. This means that when the first vehicle 20 pitches relative to the second vehicle 80, each shoe 70 will rotate. That is, while the lower surface of each shoe 70 remains in contact with the pivot bed 90, the yoke assembly arms 62, 64 may pitch relative to the second vehicle frame assembly 82. Further, each lower surface of a yoke assembly arm 62, 64, or the lower surface of each shoe 70, may have one or more shims 130 added thereto. The shims 130 are used to, effectively, level the yoke assembly 60, and therefore the first vehicle 20, relative to the second vehicle 80.

The lower surface of the yoke assembly arms 62, 64 may also include at least one slider pad 132, or, at least the bottommost shim 130 may act as a slider pad 132. The slider pads 132 have a reduced coefficient of friction relative to the materials that form the first and second frame assemblies 22, 82. This allows for reduced friction, and therefore reduced wear and tear, when the first vehicle 20 pitches relative to the second vehicle 80. The pivot bed 90 may also include arcuate tracks 134 having a reduced coefficient of friction wherein the tracks 134 correspond to the path traveled by the lower surface of the yoke assembly arms 62, 64. The tracks 134 may be simply polished metal, a recess (not shown) having a bearing (not shown) disposed therein, or simply a lubricant applied to the upper surface of the pivot bed 90.

In operation, the dual tamper vehicle 10 stops when the at least one tamping device 28 of the first vehicle 20 is disposed over a first tie 2. The at least one tamping device 28 then tamps the first worksite tie 2, as described above. The rail vehicle 10 then advances two tie 2 positions until the at least one tamping device 28 of the first vehicle 20 is disposed over another, second worksite tie 2. The at least one tamping device 28 of the first vehicle 20 then tamps the second tie 2. This operation is repeated for each alternate tie 2 until the second vehicle 20 reaches the first non-tamped tie 2 between two tamped ties 2. At this time, the at least one tamping device 86 of the second vehicle 80 tamps the untamped tie 2. As the dual tamper vehicle 10 continues to move forward, both the at least one tamping device 28 of the first vehicle 20 and the at least one tamping device 86 of the second vehicle 80 will each tamp a tie 2 each time the dual tamper vehicle 10 indexes forward. That is, the dual tamper vehicle 10 may advance over more than one tie 2 for each cycle. For example, if alternating ties 2 are identified as "odd" and "even" numbered ties 2, at least one tamping device 28 of the first vehicle 20 tamps the "odd" numbered ties 2 and the at least one tamping device 86 of the second vehicle 80 tamps the "even" numbered ties 2.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A dual tamper vehicle structured to travel over a railroad, said railroad having a ballast bed, at least two elongated, generally parallel rails, and a plurality of ties, said ties disposed on said ballast bed, said rails being disposed over and coupled to each of said plurality of ties, said dual tamper vehicle comprising:

a bifurcated vehicle assembly having a first vehicle assembly and a second vehicle assembly, the bifurcated vehicle assembly includes multiple pairs of rail wheels;

said first vehicle assembly having a first frame assembly;

said second vehicle assembly having a second frame assembly;

said first frame assembly movably coupled to said second frame assembly by a primary coupling having at least two axes of rotation; and at least one pair of rail wheels having a fixed relation, wherein said fixed relation allows for rotation about only a vertical axis.

2. The dual tamper vehicle of claim 1 wherein said primary coupling is selected from the group comprising a ball joint, a spherical bearing, a heim joint, a universal joint, or a combination joint.

3. The dual tamper vehicle of claim 1 wherein:

said second tamper assembly includes a left tamper assembly and a right tamper assembly;

said second tamper assembly left tamper assembly and said second tamper assembly right tamper assembly being separately movable in a longitudinal direction.

4. The dual tamper vehicle of claim 1 wherein:

said bifurcated vehicle assembly includes at least three pairs of rail wheels; and said at least three pairs of rail wheels including at least one pair of rail wheels having a pivotal relation with one of said first frame assembly or said second frame assembly and wherein said pivotal relation allows for rotation about a longitudinal axis.

5. The dual tamper vehicle of claim 4 wherein:

said at least one pair of rail wheels having a pivotal relation with one of said first frame assembly or said second frame assembly includes a first and a second pair of rail wheels having a pivotal relation with one of said first frame assembly or said second frame assembly; and said at least one pair of rail wheels having a fixed relation with one of said first frame assembly or said second frame assembly being disposed between said two pairs of rail wheels having a pivotal relation with one of said first frame assembly or said second frame assembly.

6. The dual tamper vehicle of claim 5 wherein:

said first pair of rail wheels having a pivotal relation are pivotally coupled to said first frame assembly;

said second pair of rail wheels having a pivotal relation are pivotally coupled to said second frame assembly; and said at least one pair of rail wheels having a fixed relation being a third pair of wheels and being coupled to said second frame assembly.

7. The dual tamper vehicle of claim 6 wherein:

said first frame assembly has a front end and a back end, as well as a yoke assembly; and said yoke assembly disposed at said first frame assembly back end;

said yoke assembly having two spaced arms and a crossbar, said crossbar coupled to, and extending between, said yoke arms;

said yoke assembly structured to be coupled to said second frame assembly at said primary coupling.

8. The dual tamper vehicle of claim 7 wherein:

said second frame assembly includes a generally planar pivot bed disposed about said primary coupling;

said crossbar is coupled to primary coupling, whereby said yoke assembly arms are disposed on opposite sides of said primary coupling;

said yoke assembly arms having a lower surface disposed adjacent to said second frame assembly pivot bed;

each said yoke assembly arm lower surface structured to engage said second frame assembly pivot bed when said first frame assembly rolls relative to said second frame assembly.

9. The dual tamper vehicle of claim 8 wherein:

said yoke assembly includes slider pads, said slider pads having a reduced coefficient of friction relative to said first and second frame assemblies; and at least one slider pad disposed on each yoke assembly arm lower surface.

10. The dual tamper vehicle of claim 9 wherein:

said bifurcated vehicle assembly includes a propulsion device, a control system, and a navigation system;

said propulsion device coupled to one of said first pair of rail wheels, said second pair of wheels, or said third pair of wheels, said propulsion device structured to propel said bifurcated vehicle assembly over said rails;

a control system structured to operate said first tamper assembly and said second tamper assembly, said control system having a communication system and a tie detection device;

said navigation system structured to track the position of the rail which is relative to a fixed location and to control the propulsion device and the motion of the frame assembly, said navigation system further structured to provide positional data to said control system; and said control system structured to combine data from said tie detection device and said navigation system whereby each tie location is determined and to track the location of said bifurcated vehicle assembly relative to said plurality of ties, whereby the positions of said first tamper assembly and said second tamper assembly relative to a worksite tie may be determine.

11. The dual tamper vehicle of claim 10 wherein:

said control system includes an orientation system having a plurality of position sensors;

said orientation system structured to determine the relative position of said first frame assembly and said second frame assembly; and said orientation system further structured to provide orientation data to said control system.

12. The dual tamper vehicle of claim 1 wherein:

said first frame assembly has a front end and a back end, as well as a yoke assembly;

said yoke assembly disposed at said first frame assembly back end;

said yoke assembly having two spaced arms and a crossbar, said crossbar coupled to, and extending between, said yoke arms;

said yoke assembly structured to be coupled to said second frame assembly at said primary coupling.

13. The dual tamper vehicle of claim 12 wherein:

said second frame assembly includes a generally planar pivot bed disposed about said primary coupling;

said crossbar is coupled to primary coupling, whereby said yoke assembly arms are disposed on opposite sides of said primary coupling;

said yoke assembly arms having a lower surface disposed adjacent to said second frame assembly pivot bed;

each said yoke assembly arm lower surface structured to engage said second frame assembly pivot bed when said first frame assembly rolls relative to said second frame assembly.

14. The dual tamper vehicle of claim 13 wherein:

said yoke assembly includes slider pads, said slider pads having a reduced coefficient of friction relative to said first and second frame assemblies; and at least one slider pad disposed on each yoke assembly arm lower surface.

15. The dual tamper vehicle of claim 14 wherein:

said first frame assembly includes a first rail wheel assembly;

said second frame assembly includes a second rail wheel assembly and a third rail wheel assembly;

said bifurcated vehicle assembly includes a propulsion device, a control system, and a navigation system;

said propulsion device coupled to one of said first pair of rail wheels, said second pair of wheels, or said third pair of wheels, said propulsion device structured to propel said bifurcated vehicle assembly over said rails;

a control system structured to operate said first tamper assembly and said second tamper assembly, said control system having a communication system and a tie detection device;

said navigation system structured to track the position of the rail which is relative to a fixed location and to control the propulsion device and the motion of the frame assembly; said navigation system further structured to provide positional data to said control system; and said control system structured to combine data from said tie detection device and said navigation system whereby each tie location is determined and to tract the location of said bifurcated vehicle assembly relative to said plurality of tires, whereby the positions of said first tamper assembly and said second tamper assembly relative to a worksite tie may be determined.

16. The dual tamper vehicle of claim 15 wherein:

said control systems includes an orientation system having a plurality of position sensors;

said orientation system structured to determine the relative position of said first frame assembly and said second frame assembly; and said orientation system further structured to provide orientation data to said control system.

17. The dual tamper vehicle of claim 1 wherein:

said first frame assembly includes a first rail wheel assembly;

said second frame assembly includes a second rail wheel assembly and a third rail wheel assembly;

said bifurcated vehicle assembly includes a propulsion device, a control system, and a navigation system;

said propulsion device coupled to one of said first pair of rail wheels, said second pair of wheels, or said third pair of wheels, said propulsion device structured to propel said bifurcated vehicle assembly over said rails;

a control system structured to operate said first tamper assembly and said second tamper assembly, said control system having a communication system;

said navigation systems structured to track the position of the rail which is relative to a fixed location and to control the propulsion device and the motion of the frame assembly, said navigation system further structured to provide positional data to said control system; and said control system structured to combine data from said tie detection device and said navigation system whereby each tie location is determined and to track the location of said bifurcated vehicle assembly relative to said plurality of ties, whereby the positions of said first tamper assembly and said second tamper assembly relative to a worksite tie may be determined.

18. The dual tamper vehicle of claim 17 wherein:

said control system includes an orientation system having a plurality of position sensors;

said orientation system structured to determine the relative position of said first frame assembly and said second frame assembly; and said orientation system further structured to provide orientation data to said control system.

19. A dual tamper vehicle structured to travel over a railroad, said railroad having a ballast bed, at least two elongated, generally parallel rails, and a plurality of ties, said ties disposed on said ballast bed, said rails being disposed over and coupled to each of said plurality of ties, said dual tamper vehicle comprising:

a single articulated vehicle assembly having a first vehicle assembly and a second vehicle assembly;

said first vehicle assembly having a first frame assembly, a first tamper assembly being coupled to said first frame assembly, said first tamper assembly is longitudinally fixed to said first frame assembly, a first pair of rail wheels being coupled to the first frame assembly;

said second vehicle assembly having a second frame assembly, a second tamper assembly being coupled to said second frame assembly, said second tamper assembly is structured to move longitudinally relative to said second frame member, a second pair of rail wheels and a third pair of rail wheels being coupled to the second frame assembly; and said first frame assembly movably coupled to said second frame assembly by a primary coupling having at least two axes of rotation;

at least one pair of rail wheels having a fixed relation with one of said first frame assembly or said second frame assembly, wherein said fixed relation allows for rotation about only a vertical axis.

20. A dual tamper vehicle structured to travel over a railroad, said railroad having a ballast bed, at least two elongated, generally parallel rails, and a plurality of ties, said ties disposed on said ballast bed, said rails being disposed over and coupled to each of said plurality of ties, said dual tamper vehicle comprising:

a bifurcated vehicle assembly having a first vehicle assembly and a second vehicle assembly;

said first vehicle assembly having a first frame assembly;

said second vehicle assembly having a second frame assembly;

said first frame assembly movably coupled to said second frame assembly by a primary coupling having at least two axes of rotation; and said second frame assembly including a generally planar pivot bed disposed about said primary coupling.

21. A dual tamper vehicle structured to travel over a railroad, said railroad having a ballast bed, at least two elongated, generally parallel rails, and a plurality of ties, said ties disposed on said ballast bed, said rails being disposed over and coupled to each of said plurality of ties, said dual tamper vehicle comprising:

a bifurcated vehicle assembly having a first vehicle assembly and a second vehicle assembly;

said first vehicle assembly having a first frame assembly, a first tamper assembly being coupled to said first frame assembly;

said second vehicle assembly having a second frame assembly, a second tamper assembly being coupled to said second frame assembly;

said first frame assembly movably coupled to said second frame assembly by a primary coupling having at least two axes of rotation;

a tie detection device and a navigation system; and a control system structured to operate said first tamper assembly and said second tamper assembly, said control system structured to combine data from the tie detection device and the navigation system whereby each tie location is determined to track the location of said bifurcated vehicle assembly relative to said plurality of ties.

* * * * *